US009266327B2

(12) United States Patent
Hirai et al.

(10) Patent No.: US 9,266,327 B2
(45) Date of Patent: Feb. 23, 2016

(54) LIQUID EJECTING HEAD AND LIQUID EJECTING APPARATUS

(71) Applicant: SEIKO EPSON CORPORATION, Tokyo (JP)

(72) Inventors: Eiju Hirai, Minowa-machi (JP); Shiro Yazaki, Chino (JP); Motoki Takabe, Shiojiri (JP); Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/627,845

(22) Filed: Feb. 20, 2015

(65) Prior Publication Data

US 2015/0246538 A1 Sep. 3, 2015

(30) Foreign Application Priority Data

Feb. 28, 2014 (JP) ..... 2014-037678

(51) Int. Cl.
*B41J 2/045* (2006.01)
*B41J 2/14* (2006.01)

(52) U.S. Cl.
CPC .... *B41J 2/14233* (2013.01); *B41J 2002/14266* (2013.01); *B41J 2002/14459* (2013.01); *B41J 2002/14491* (2013.01)

(58) Field of Classification Search
CPC ..... B41J 2/14201; B41J 2/14233; B41J 2002/14266
See application file for complete search history.

(56) References Cited

U.S. PATENT DOCUMENTS

| | | | | |
|---|---|---|---|---|
| 5,956,059 | A * | 9/1999 | Usui | 347/71 |
| 6,336,717 | B1 * | 1/2002 | Shimada et al. | 347/71 |
| 6,350,019 | B1 * | 2/2002 | Shingai et al. | 347/70 |
| 7,364,275 | B2 * | 4/2008 | Lim et al. | 347/70 |
| 2009/0244213 | A1 | 10/2009 | Shimada | |
| 2009/0284568 | A1 | 11/2009 | Yazaki | |

FOREIGN PATENT DOCUMENTS

| | | |
|---|---|---|
| EP | 0 707 961 | 4/1996 |
| EP | 1 067 609 | 1/2001 |
| EP | 1067609 | 1/2001 |
| EP | 1 459 900 | 9/2004 |
| EP | 1459000 | 9/2004 |
| JP | 2009-172878 | 8/2009 |

OTHER PUBLICATIONS

European Search Report for Application No. 15156943.1 dated Nov. 27, 2015.

* cited by examiner

*Primary Examiner* — Geoffrey Mruk
(74) *Attorney, Agent, or Firm* — Workman Nydegger

(57) ABSTRACT

A liquid ejecting head includes a pressure chamber forming substrate in which a plurality of spaces to be pressure chambers in communication with nozzles are provided side by side in a nozzle column direction, in which in a region corresponding to the pressure chamber, a lower electrode film is formed with a width of 50% or more and 80% or less of a width of the pressure chamber in the nozzle column direction and the piezoelectric body layer covers the lower electrode film in the nozzle column direction and is formed with a width of 90% or less of the width of the pressure chamber.

4 Claims, 6 Drawing Sheets

LIQUID EJECTING HEAD AND LIQUID EJECTING APPARATUS

The entire disclosure of Japanese Patent Application No: 2014-037678, filed Feb. 28, 2014 is expressly incorporated by reference herein in its entirety.

BACKGROUND

1. Technical Field

The present invention relates to a liquid ejecting head that ejects liquid by driving of a piezoelectric element and a liquid ejecting apparatus including the same.

2. Related Art

A liquid ejecting apparatus is an apparatus including a liquid ejecting head and ejects various types of liquid from the ejecting head. As a liquid ejecting apparatus, for example, there is an image recording apparatus such as an ink jet type printer or an ink jet type plotter and recently, image recording apparatuses have become applicable to various manufacturing apparatuses by utilizing features that can accurately land a small amount of the liquid at a predetermined position. For example, an image recording apparatus is applicable as a display manufacturing apparatus for manufacturing a color filter of a liquid crystal display and the like, an electrode forming apparatus for forming an electrode of an organic Electro Luminescence (EL) display or a field emission display (FED), and the like, and a chip manufacturing apparatus for manufacturing bio-chips (biological and chemical elements). Then, a liquid ink is ejected from the recording head of the image recording apparatus and a solution for each color of Red (R), Green (G), and Blue (B) is ejected from a color material ejecting head of the display manufacturing apparatus. Furthermore, a liquid electrode material is ejected from an electrode material ejecting head for the electrode forming apparatus and solution of a bio-organic material is ejected from a bio organic material ejecting head for the chip manufacturing apparatus.

The liquid ejecting head described above is configured such that, the liquid is introduced into a pressure chamber, pressure variation is generated in the liquid of the pressure chamber, and the liquid is ejected from nozzles leading to the pressure chamber. As a pressure generation unit that generates the pressure variation in the liquid inside the pressure chamber, a piezoelectric element is preferably used. For example, the piezoelectric element is configured such that a lower electrode film that functions as an individual electrode provided for each pressure chamber, a piezoelectric body layer of lead zirconate titanate (PZT) and the like, and an upper electrode film that functions as a common electrode common to a plurality of pressure chambers are respectively laminated and formed by a film forming technology in order from a side close to the pressure chamber (for example, JP-A-2009-172878). In such a piezoelectric element, a width of the piezoelectric body layer is formed wider than a width of the lower electrode film so that the piezoelectric body layer covers the lower electrode film in a region corresponding to the pressure chamber. Then, a portion sandwiched between the upper and lower electrode films in the piezoelectric body layer is an active section that is deformed by applying a voltage to the electrode films. Such a piezoelectric element is formed on a vibration plate defining one side (for example, opposite side to a nozzle plate in which the nozzles are formed) of the pressure chamber. The vibration plate has flexibility and is deformed depending on the deformation of the piezoelectric element.

Here, as an indicator for performance evaluation of the liquid ejecting head, there is a so-called excluded volume. The excluded volume means a change amount (a volume of liquid excluded from the pressure chamber) of the volume of the pressure chamber when the piezoelectric element is driven by applying a predetermined drive voltage. The excluded volume increases or decreases depending on an area of the active section of the piezoelectric element that is laminated in a region corresponding to the pressure chamber. Thus, it is possible to efficiently eject the liquid from the nozzles by improving the excluded volume.

However, in order to increase an area of the active section of the piezoelectric element, if a width (dimension in a nozzle column direction) of the lower electrode film (individual electrode) is increased, the excluded volume may be reduced. Specifically, since the piezoelectric body layer is configured so as to cover the lower electrode film for suppressing insulation breakdown between the upper electrode film and the lower electrode film, the width of the piezoelectric body layer is also increased along with the width of the lower electrode film being increased. Thus, the width of the piezoelectric body layer is relatively increased with respect to the width of the pressure chamber (opening of a space that is the pressure chamber on the piezoelectric element side) and a width of a region in which the piezoelectric body layer is not laminated is relatively decreased in the region corresponding to the pressure chamber. As a result, deformation of the vibration plate is inhibited in the region and the excluded volume is reduced.

SUMMARY

An advantage of some aspects of the invention is to provide a liquid ejecting head capable of efficiently ejecting liquid by achieving improvement of excluded volume and a liquid ejecting apparatus.

According to an aspect of the invention, there is provided a liquid ejecting head including: a pressure chamber forming substrate in which a plurality of spaces to be pressure chambers in communication with nozzles are provided side by side; and a piezoelectric element which faces a vibration plate defining the pressure chambers by sealing openings of the spaces in the pressure chamber forming substrate and in which a first electrode layer, a piezoelectric body layer, and a second electrode layer are laminated in order from the vibration plate. In a region corresponding to the pressure chamber, the first electrode layer is formed with a width of 50% or more and 80% or less of a width of the pressure chamber in a first direction and the piezoelectric body layer covers the first electrode layer in the first direction and is formed with a width of 90% or less of the width of the pressure chamber.

In this case, since the first electrode layer is formed with the width of 50% or more and 80% or less of the width of the pressure chamber and the piezoelectric body layer is formed with the width of 90% or less of the width of the pressure chamber, it is possible to improve the excluded volume when driving the piezoelectric element. As a result, it is possible to efficiently eject the liquid from the nozzles.

It is preferable that in the region corresponding to the pressure chamber, the first electrode layer be formed with the width of 54% or more and 72% or less of the width of the pressure chamber in the first direction and the piezoelectric body layer be formed with the width of 80% or less of the width of the pressure chamber in the first direction.

In this case, since the first electrode layer is formed with the width of 54% or more and 72% or less of the width of the pressure chamber and the piezoelectric body layer is formed with the width of 80% or less of the width of the pressure chamber, it is possible to further improve the excluded volume when driving the piezoelectric element. As a result, it is possible to more efficiently eject the liquid from the nozzles.

According to another aspect of the invention, there is provided a liquid ejecting apparatus including: the liquid ejecting head according to each configuration described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. Moreover, in the embodiments described below, various limitations are provided as preferred specific examples of the invention, but the scope of the invention is not limited to the embodiments unless there is a particular description to limit the invention in the following description. Furthermore, in the following description, as the liquid ejecting apparatus of the invention, an ink jet type printer (hereinafter, referred to as a printer) equipped with an ink jet type recording head (hereinafter, referred to as a recording head) that is a type of a liquid ejecting head is exemplified.

Figure 1:
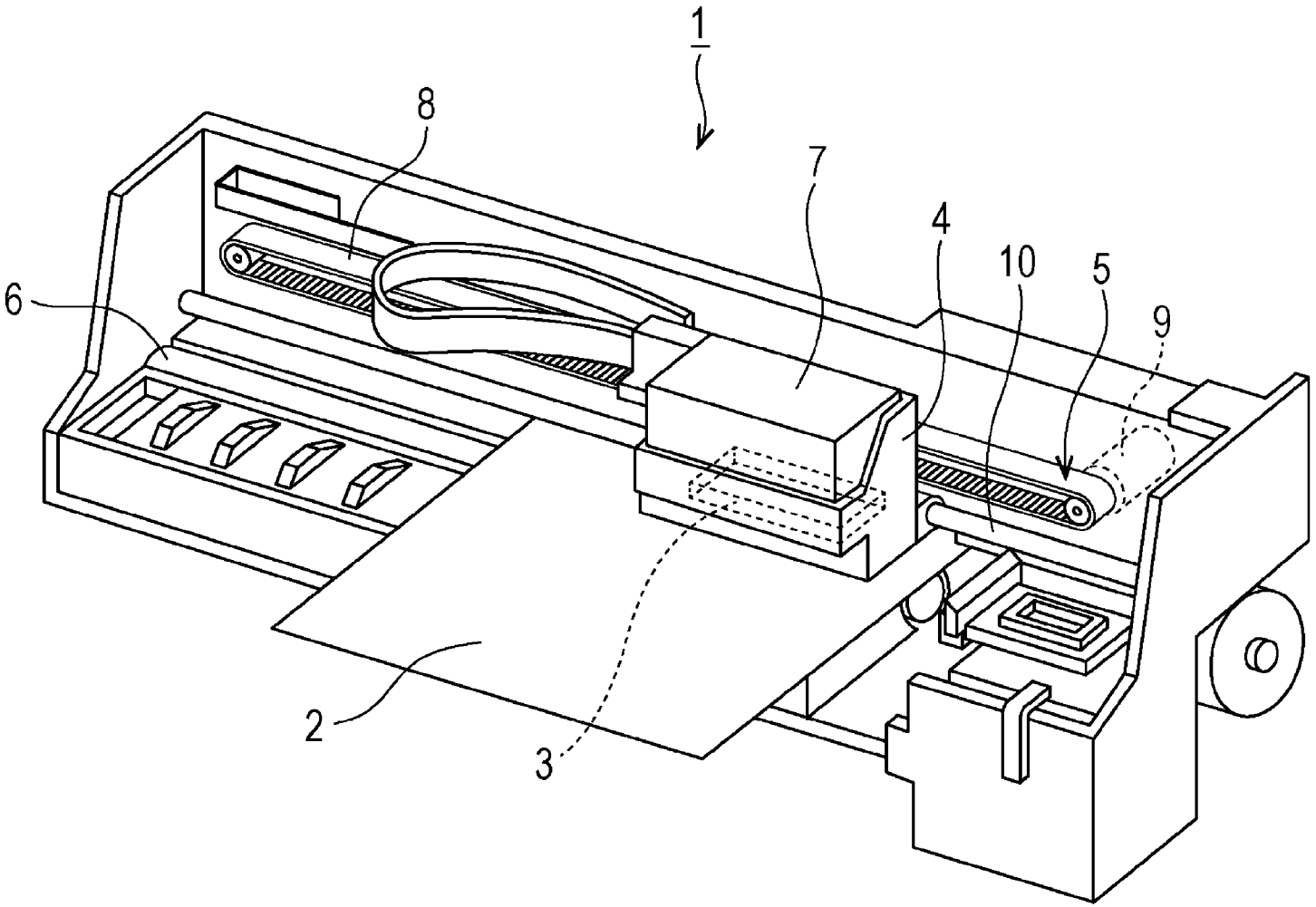
FIG. 1 is a perspective view illustrating a configuration of a printer.

A configuration of a printer 1 will be described with reference to FIG. 1. The printer 1 is an apparatus that performs recording of an image and the like by ejecting liquid ink on a surface of a recording medium 2 (a type of a landing object) such as a recording sheet. The printer 1 includes a recording head 3, a carriage 4 on which the recording head 3 is mounted, a carriage moving mechanism 5 that moves the carriage 4 in a main scanning direction, a transportation mechanism 6 that transports the recording medium 2 in a sub-scanning direction, and the like. Here, the ink is a type of a liquid of the invention and is stored in an ink cartridge 7 as a liquid supply source. The ink cartridge 7 is detachably mounted on the recording head 3. Moreover, a configuration in which the ink cartridge is disposed on a body side of the printer and the ink is supplied from the ink cartridge to the recording head through an ink supply tube can be employed.

The carriage moving mechanism 5 includes a timing belt 8. The timing belt 8 is driven by a pulse motor 9 such as a DC motor. Thus, when the pulse motor 9 is operated, the carriage 4 is guided by a guide rod 10 installed in the printer 1 and reciprocates in the main scanning direction (width direction of the recording medium 2).

Figure 2:
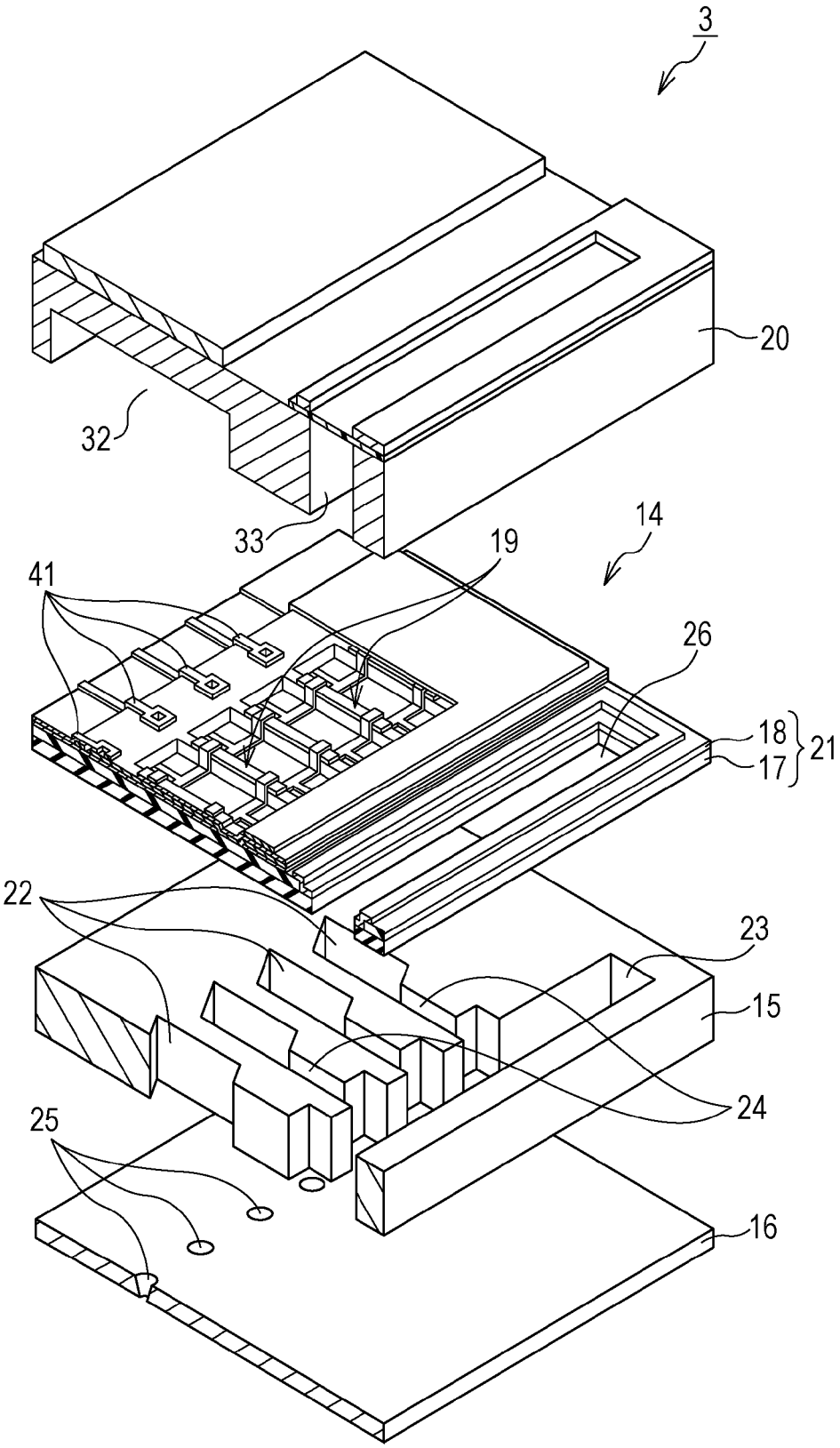
FIG. 2 is an exploded perspective view of a recording head.
Figure 3:
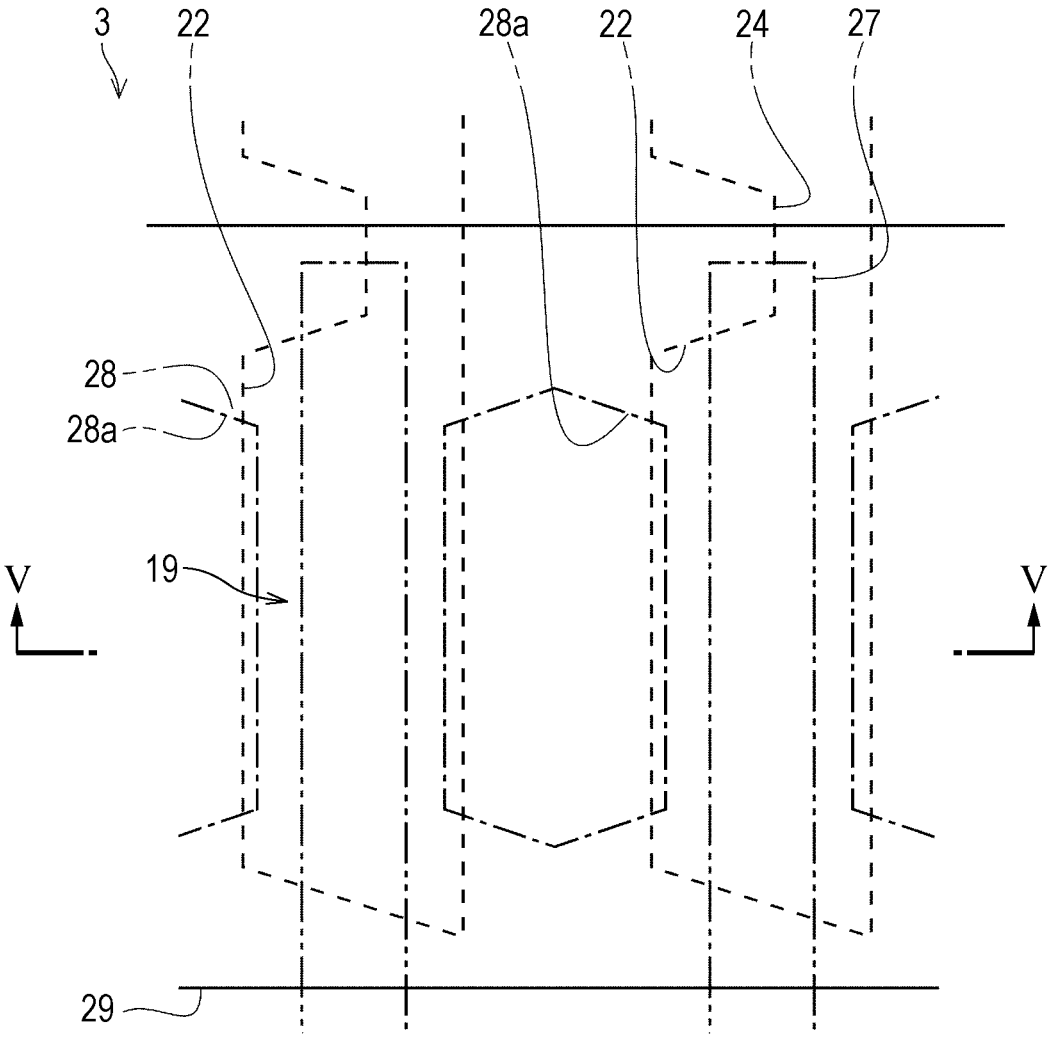
FIG. 3 is a plan view of the recording head.
Figure 4:
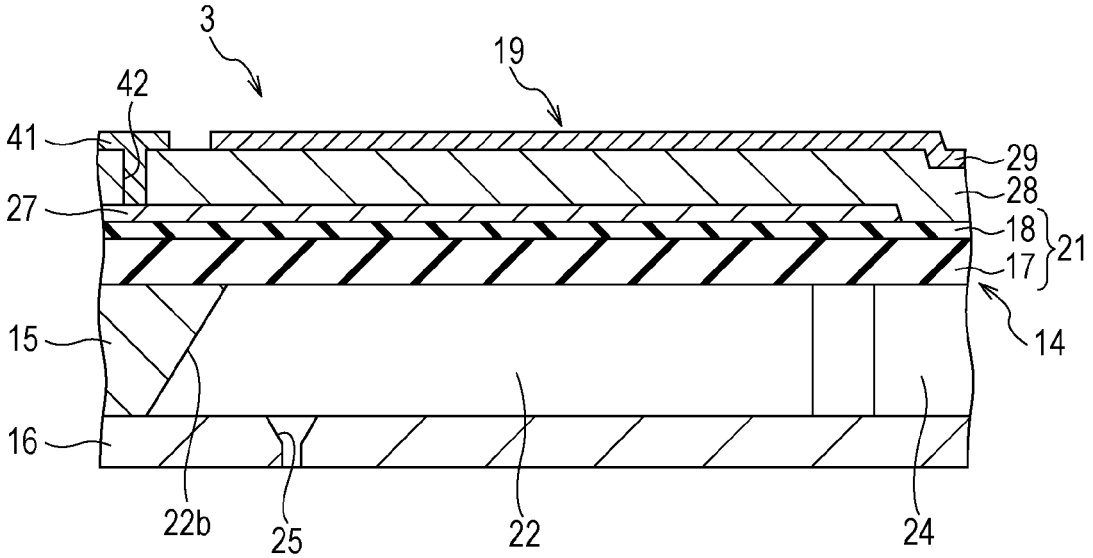
FIG. 4 is a schematic view of a cross section along a direction crossing a nozzle column illustrating a configuration of a main portion of the recording head.
Figure 5:
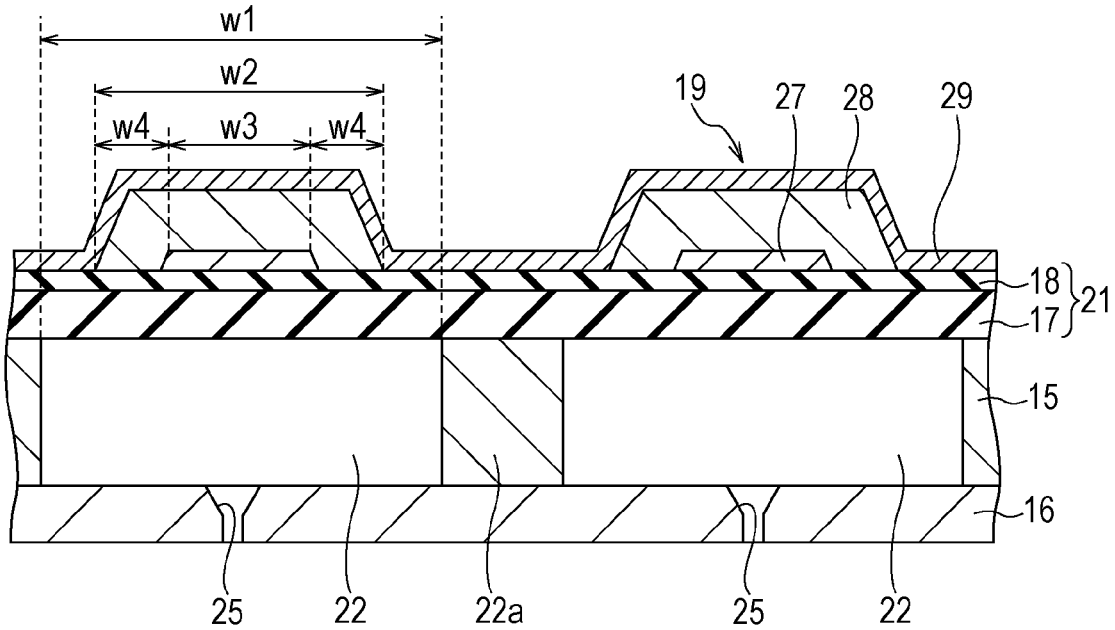
FIG. 5 is a cross-sectional view that is taken along line V-V in FIG. 3.

FIG. 2 is an exploded perspective view illustrating a configuration of the recording head 3 of the embodiment. Furthermore, FIG. 3 is a plan view (upper view) of the recording head 3. Moreover, FIG. 3 illustrates a state where a sealing plate 20 described below is not attached. That is, FIG. 3 is a plan view of a vibration plate 21 in which each layer described below is laminated. Furthermore, FIGS. 4 and 5 are views of a configuration of a main portion of the recording head 3. FIG. 4 is a schematic view of a cross section along a direction orthogonal to a nozzle column and FIG. 5 is a schematic view of a cross section (cross section taken along line V-V in FIG. 3) along the nozzle column direction.

The recording head 3 according to the embodiment is configured by laminating a pressure chamber forming substrate 15, a nozzle plate 16, an actuator unit 14, the sealing plate 20, and the like. The pressure chamber forming substrate 15 is a plate material formed of a silicon single crystal substrate in the embodiment. In the pressure chamber forming substrate 15, spaces (corresponding to spaces in the invention, hereinafter, appropriately referred to as pressure chamber spaces) that are a plurality of pressure chambers 22 are arranged side by side in which partition walls 22*a* are interposed therebetween. The pressure chamber spaces are spaces elongated in a direction orthogonal to the nozzle column direction and are provided in one-to-one correspondence nozzles 25 with the nozzles 25 of the nozzle plate 16. That is, each pressure chamber space (or the pressure chamber 22) is formed at the same pitch as a formation pitch of the nozzles 25 along the nozzle column direction (first direction of the invention).

Moreover, as illustrated in FIG. 3, an upper opening (opening on the opposite side to the nozzle 25 side) of the pressure chamber 22 (pressure chamber space) has a trapezoidal shape in the embodiment. Furthermore, as illustrated in FIG. 4, a wall 22*b* of an end portion on the nozzle 25 side in a longitudinal direction of the pressure chamber 22 (pressure chamber space) is partially inclined with respect to the vertical surface of a flow path forming substrate 15. Regarding a dimension of the pressure chamber (pressure chamber space), a height (that is, thickness of the pressure chamber forming substrate 15) of the pressure chamber 22 is set to be approximately 70 μm. Furthermore, a length (dimension in a direction orthogonal to the nozzle column direction) of the pressure chamber 22 in the longitudinal direction is set to be approximately 360 μm. Furthermore, a width w1 (dimension in the nozzle column direction) in a short direction of the pressure chamber 22 illustrated in FIG. 5 is set to be approximately 70 μm. Moreover, the dimensions (length and the width) of the pressure chamber 22 in the invention mean inside measurements of an upper opening (opening on the vibration plate 21 side) of the pressure chamber space.

Furthermore, as illustrated in FIG. 2, in the pressure chamber forming substrate 15, a communication section 23 which passes through the pressure chamber forming substrate 15 is formed in a region outside on a side (opposite side to a communication side with the nozzles 25) in the longitudinal direction of the pressure chamber space with respect to the pressure chamber space along an arrangement direction of the pressure chamber space. The communication section 23 is a space common to each pressure chamber space. The communication section 23 and each pressure chamber space communicate with each other through an ink supply path 24. Moreover, the communication section 23 communicates with a communication opening section 26 of the vibration plate 21 described below and a hollow liquid chamber section 33 of the sealing plate 20 and configures a reservoir (common liquid chamber) that is a common ink chamber in each pressure chamber space (the pressure chamber 22). The ink supply path 24 is formed with a width narrower than that of the pressure chamber space and is a portion serving as a flow path resistance with respect to the ink flowing from the communication section 23 into the pressure chamber space.

The nozzle plate 16 (nozzle forming substrate) is bonded to a lower surface (surface on the opposite side to a bonding surface side to the actuator unit 14) of the pressure chamber forming substrate 15 through adhesive or a heat welding film, and the like. In the embodiment, in the nozzle plate 16, the nozzles 25 are provided side by side at a pitch (distance between centers of adjacent nozzles 25) corresponding to a document formation density (for example, 300 dpi to 600 dpi). The nozzles 25 communicate with each other in an end portion opposite side to the ink supply path 24 with respect to the pressure chamber space. Moreover, for example, the nozzle plate 16 is made of a silicon single crystal substrate or stainless steel, and the like.

The actuator unit 14 is configured of the vibration plate 21 and a piezoelectric element 19. The vibration plate 21 is configured of an elastic film 17 formed of silicon oxide ($SiO_x$) (for example, silicon dioxide ($SiO_2$)) formed on the upper surface of the pressure chamber forming substrate 15 and an insulator film 18 formed of zirconium oxide ($ZrO_x$) formed on the elastic film 17. A portion corresponding to the pressure chamber space in the vibration plate 21, that is, a portion defining a part of the pressure chamber 22 closing an upper opening of the pressure chamber space functions as a displacement section which is displaced in a direction going away from the nozzle 25 or a direction approaching the nozzle 25 according to a bending deformation of the piezoelectric element 19. Moreover, it is preferable that the thickness of the elastic film 17 be set to be 300 nm to 2000 nm and it is preferable that the thickness of the insulator film 18 be set to be 30 nm to 600 nm. Furthermore, as illustrated in FIG. 2, the communication opening section 26 communicating with the communication section 23 opens in a portion corresponding to the communication section 23 of the pressure chamber forming substrate 15 in the vibration plate 21.

The piezoelectric element 19 is formed in a portion corresponding to the pressure chamber space of the vibration plate 21 (the insulator film 18), that is, in the upper surface (surface opposite side to the nozzle 25 side) of the displacement section. In the embodiment, the piezoelectric element 19 is configured by a film forming technology by laminating a lower electrode film 27 (corresponding to a first electrode layer in the invention), a piezoelectric body layer 28, and an upper electrode film 29 (corresponding to a second electrode in the invention) by a film forming technology in order from the vibration plate 21 side. As illustrated in FIG. 5, lower electrode films 27 are independently provided for each pressure chamber 22 and the upper electrode film 29 is provided continuously over a plurality of pressure chambers 22. Thus, the lower electrode film 27 is an individual electrode for each pressure chamber 22 and the upper electrode film 29 is a common electrode common to each pressure chamber 22.

Specifically, as illustrated in FIGS. 3 and 5, both end portions of the upper electrode film 29 in the nozzle column direction extend to the outside of a plurality of the pressure chamber spaces (the pressure chambers 22) arranged over an edge of the upper opening of the pressure chamber spaces. Furthermore, as illustrated in FIGS. 3 and 4, both end portions of the upper electrode film 29 in the longitudinal direction (direction orthogonal to the nozzle column direction) of the pressure chamber 22 extend to the outside of the pressure chamber space (the pressure chamber 22) over the edge of the upper opening of the pressure chamber space. An end portion of one side (upper side in FIG. 3) of the lower electrode film 27 in the longitudinal direction of the pressure chamber 22 extends to a position overlapping the ink supply path 24 over the edge of the upper opening of the pressure chamber space and an end portion of the other side (lower side in FIG. 3) extends to a lead electrode section 41. Then, as illustrated in FIG. 5, a width w3 of the lower electrode film 27 in the nozzle column direction on the pressure chamber space (region corresponds to the pressure chamber 22) is formed narrower than the width w1 of the pressure chamber 22 in the nozzle column direction. Furthermore, a width w2 of the piezoelectric body layer 28 in the nozzle column direction on the pressure chamber space is formed narrower than the width w1 of the pressure chamber 22 in the same direction, and is formed wider than the width w3 of the lower electrode film 27 in the same direction, and covers the lower electrode film 27. Here, in the invention, a ratio of the width w3 of the lower electrode film 27 to the width w1 of the pressure chamber 22, and a ratio of the width w2 of the piezoelectric body layer 28 to the width w1 of the pressure chamber 22 are defined, and thereby the excluded volume is improved. Detailed description will be described below.

Moreover, in the nozzle column direction, it is preferable that a distance w4 from an outer end of one side of the lower electrode film 27 to an outer end of the same side of the piezoelectric body layer 28, in other words, a width w4 of the piezoelectric body layer 28 outside of the lower electrode film 27 on one side be set to be 2 μm or more considering a manufacturing error. That is, in the nozzle column direction, it is preferable that the width of the piezoelectric body layer 28 in a region outside from the lower electrode film 27 on both sides be set to be a total of 4 μm or more. Thus, it is possible to sufficiently secure a distance between the lower electrode film 27 and the upper electrode film 29 in the region even if an error is included and it is possible to suppress insulation breakdown (electrostatic breakdown) between the electrode films.

Furthermore, in the embodiment, as illustrated in FIG. 3, the piezoelectric body layer 28 is divided for each piezoelectric element 19 by an opening section **28*a* in which the piezoelectric body layer 28 is partially removed. Specifically, the piezoelectric body layer 28 extends to the outside over both end portions (specifically, upper opening edge on both sides of the pressure chamber space) in the longitudinal direction of the pressure chamber 22 and is formed through the plurality of pressure chambers 22. Then, the piezoelectric body layer 28 of a region corresponding to a portion between adjacent pressure chambers 22 is partially removed and a plurality of opening sections 28*a* in which the piezoelectric body layer 28 is not laminated are formed. That is, the plurality of opening sections 28*a* are formed at the same pitch as the formation pitch (formation pitch of the nozzles 25) of the pressure chambers 22 along the nozzle column direction. In other words, the piezoelectric element 19 corresponding to one pressure chamber 22 is formed at the same pitch as the formation pitch of the pressure chambers 22 between the opening section 28*a* and the opening section 28*a*. Moreover, the opening section 28*a* of the embodiment is formed in an elongated hexagonal shape along the longitudinal direction of the pressure chamber 22 in a plan view. Furthermore, in the longitudinal direction of the pressure chamber 22, the piezoelectric body layer 28 of the region outside of the opening section 28*a* is continuously formed through the plurality of pressure chambers 22. In the embodiment, a length in the longitudinal direction of the opening section 28*a* is formed approximately 360 μm and a length of a long side (side of the left side or the right side in FIG. 3) of the opening section 28*a* having the elongated hexagonal shape is formed to be approximately 342 μm. Here, in the embodiment, the width w2 of the piezoelectric body layer 28 is a width of the piezoelectric body layer 28 that is formed between the long side of one opening section 28***a* and the long side of the other opening section 28*a*. In short, the width w1 of the pressure chamber 22, the width w2 of the piezoelectric body layer 28, and the width w3 of the lower electrode film 27 are a width of a portion in which the piezoelectric element 19 is practically vibrated in each pressure chamber 22.

In the piezoelectric element 19 that is configured as described above, a region in which the lower electrode film 27, the piezoelectric body layer 28, and the upper electrode film 29 are laminated, that is, a region in which the piezoelectric body layer 28 is interposed between the lower electrode film 27 and the upper electrode film 29 is the active section in which piezoelectric strain is generated by applying a voltage to both electrode films 27 and 29.

Moreover, for the upper electrode film 29 and the lower electrode film 27, various metals such as iridium (Ir), platinum (Pt), titanium (Ti), tungsten (W), tantalum (Ta), and molybdenum (Mo), and alloys thereof are used. Furthermore, for the piezoelectric body layer 28, a ferroelectric and piezoelectric material such as lead zirconate titanate (PZT), and a relaxer ferroelectric that is formed by adding a metal such as niobium, nickel, magnesium, bismuth or yttrium to a ferroelectric and piezoelectric material, and the like are used. Moreover, it is preferable that the thickness of the upper electrode film 29 be set to be 30 nm to 100 nm. Furthermore, it is preferable that the thickness of the lower electrode film 27 be set to be 50 nm to 300 nm. Furthermore, it is preferable that the thickness (specifically, thickness of the piezoelectric body layer 28 in the active section) of the piezoelectric body layer 28 be set to be 0.7 μm to 5 μm.

The lead electrode section 41 is formed in a position (position on the left side in FIG. 4) having a predetermined gap with respect to the upper electrode film 29 on the piezoelectric body layer 28 in a region that is out on the outside further than an upper opening edge of the pressure chamber space in the longitudinal direction of the pressure chamber space. Then, as illustrated in FIG. 4, a through hole 42 from the upper surface of the piezoelectric body layer 28 to the lower electrode film 27 is formed at a position in which the lead electrode section 41 is formed in the piezoelectric body layer 28 in a state of passing through the piezoelectric body layer 28. The lead electrode section 41 is patterned corresponding to the lower electrode film 27 that is the individual electrode. The lead electrode section 41 is electrically connected to the lower electrode film 27 through the through hole 42. Then, a drive voltage (drive pulse) is selectively applied to each piezoelectric element 19 through the lead electrode section 41.

As illustrated in FIG. 2, the sealing plate 20 having a storage hollow section 32 that is capable of storing the piezoelectric element 19 is bonded to the upper surface on the opposite side to the lower surface that is a bonding surface with the pressure chamber forming substrate 15 in the actuator unit 14. The hollow liquid chamber section 33 is provided in a region corresponding to the communication opening section 26 of the vibration plate 21 and the communication section 23 of the pressure chamber forming substrate 15 in a position that is out on the outside further than the storage hollow section 32 in a direction orthogonal to the nozzle column in the sealing plate 20. The hollow liquid chamber section 33 is provided along the arrangement direction of the pressure chamber space (the pressure chamber 22) by passing through the sealing plate 20 in the thickness direction. As described above, the hollow liquid chamber section 33 defines a reservoir that is the common ink chamber for each pressure chamber space in communication with the communication opening section 26 and the communication section 23 in series. Moreover, even though not illustrated, a wiring opening section passing through the sealing plate 20 in the thickness direction is provided in the sealing plate 20 in addition to the storage hollow section 32 and the hollow liquid chamber section 33. An end portion of the lead electrode section 41 is exposed inside the wiring opening section. Then, a terminal of a wiring material (not illustrated) from a printer body side is electrically connected to the exposed portion of the lead electrode section 41.

In the recording head 3 having the configuration described above, the ink is taken from the ink cartridge 7 and the ink fills a flow path leading up to the reservoir, the ink supply path 24, the pressure chamber 22, and the nozzle 25. Then, an electric field corresponding to a potential difference between both electrodes is applied between the lower electrode film 27 and the upper electrode film 29 respectively corresponding to the pressure chamber 22 by supplying the drive signal from the printer body side. Pressure variation is generated inside the pressure chamber 22 by displacing the displacement section of the piezoelectric element 19 and the vibration plate 21. The ink is ejected from the nozzle 25 by controlling the pressure variation.

Meanwhile, as an indicator for performance evaluation of such a recording head 3, there is a case where the displacement amount of the piezoelectric element 19 (the piezoelectric body layer 28) or the excluded volume is obtained. The displacement amount of the piezoelectric element 19 means the maximum deformation amount of the piezoelectric element 19 when driving the piezoelectric element 19 by applying a predetermined drive voltage. On the other hand, the excluded volume means an amount of change (volume of the liquid excluded from the pressure chamber 22) of the volume of the pressure chamber 22 when driving the piezoelectric element 19 by applying a predetermined drive voltage. Both are related to an ejection amount of the ink from the nozzle 25 and increases or decreases in accordance with a size of the active section of the piezoelectric element 19, but the displacement amount of the piezoelectric element 19 and the excluded volume are not necessarily in a proportional relationship. For example, if the width of the lower electrode film 27 is changed in the nozzle column direction, the maximum value of the displacement amount of the piezoelectric element 19 and the maximum value of the excluded volume may be different. That is, the width of the lower electrode film 27 indicating a peak value of the displacement amount of the piezoelectric element 19 and the width of the lower electrode film 27 indicating a peak value of the excluded volume may not match. Here, as described above, since the excluded volume indicates the amount of change of the volume of the pressure chamber 22, it is possible to indicate the ejection amount of the ink more accurately in the excluded volume than the displacement amount of the piezoelectric element 19. Thus, in the recording head 3 according to the invention, improvement of the excluded volume is achieved by defining the width of the lower electrode film 27 and the width of the piezoelectric body layer 28 in the nozzle column direction.

Specifically, in the recording head 3 according to the invention, the lower electrode film 27 is formed with a width of 50% or more and 80% or less with respect to the width of the pressure chamber 22 in the nozzle column direction and the piezoelectric body layer 28 covers the lower electrode film 27 and is formed with a width of 90% or less with respect to the width of the pressure chamber 22. It is possible to provide the recording head 3 in which the excluded volume has an optimum range by formation in this way. This point will be described with reference to FIG. 6.

Figure 6:
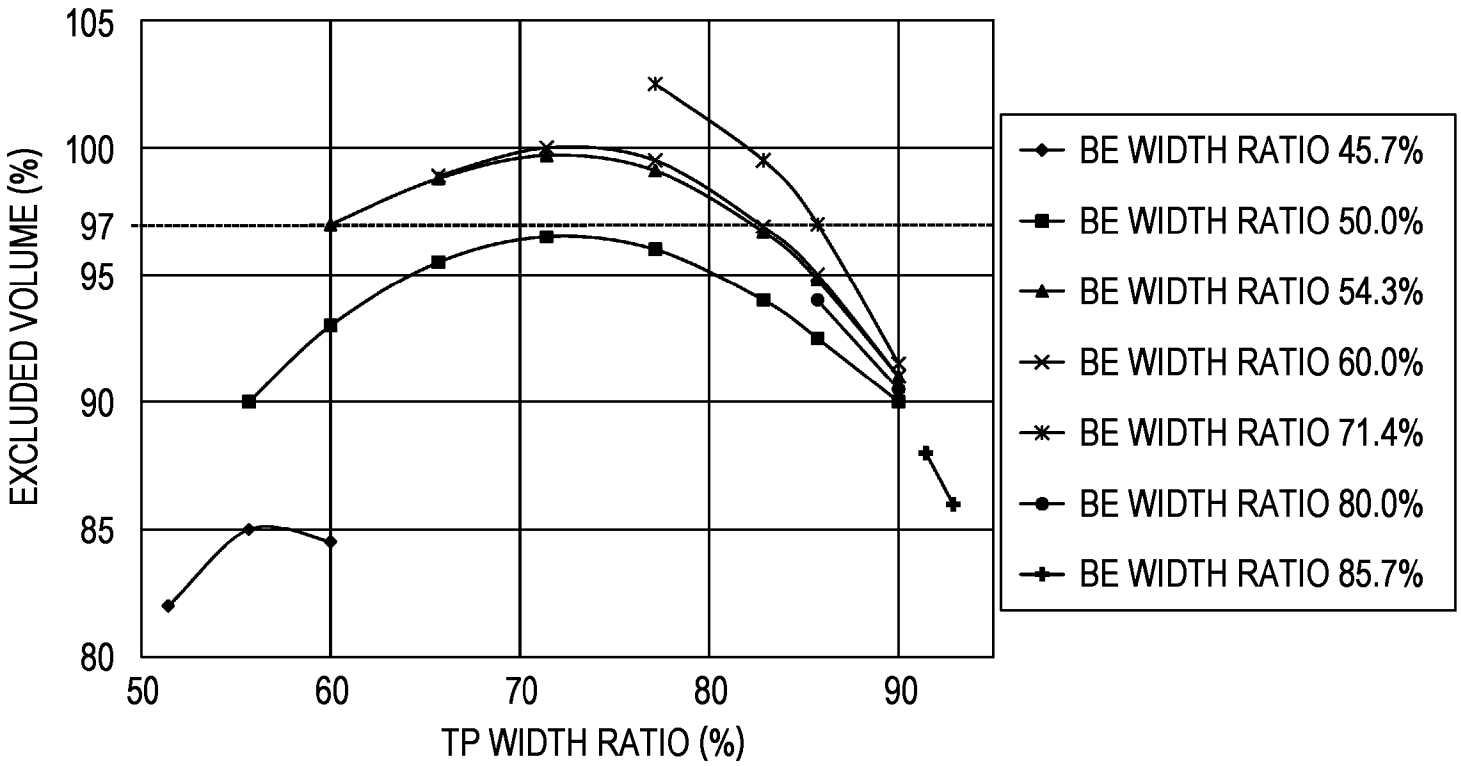
FIG. 6 is a graph illustrating a change of an excluded volume when a width of a piezoelectric body layer is changed.

FIG. 6 is a graph illustrating a change in the excluded volume when the width w1 of the piezoelectric body layer 28 is changed. "BE width ratio" in the graph indicates a ratio of the width w3 of the lower electrode film 27 to the width w1 of the pressure chamber 22 in the nozzle column direction, and "TP width ratio" indicates a ratio of the width w2 of the piezoelectric body layer 28 to the width w1 of the pressure chamber 22 in the nozzle column direction. In FIG. 6, in a case where the BE width ratio was 45.7% (in the embodiment, the width w3 of the lower electrode film 27 was 32 μm), a case where the BE width ratio was 50.0% (in the embodiment, the width w3 of the lower electrode film 27 was 35 μm), a case where the BE width ratio was 54.3% (in the embodiment, the width w3 of the lower electrode film 27 was 38 μm), a case where the BE width ratio was 60.0% (in the embodiment, the width w3 of the lower electrode film 27 was 42 μm), a case where the BE width ratio was 71.4% (in the embodiment, the width w3 of the lower electrode film 27 was 50 μm), a case where the BE width ratio was 80.0% (in the embodiment, the width w3 of the lower electrode film 27 was 56 μm), and a case where the BE width ratio was 85.7% (in the embodiment, the width w3 of the lower electrode film 27 was 60 μm), the change in the excluded volume was examined when changing the TP width ratio. Furthermore, the value of the excluded volume was set as a reference (100%) to a value when the BE width ratio was 60.0% and the TP width ratio was 71.4% (in the embodiment, the width w2 of the piezoelectric body layer 28 was 50 μm) and is indicated by a percentage (%) with respect to the value.

Moreover, as described above, from the viewpoint of suppressing the insulation breakdown, it is necessary to widen the width w2 of the piezoelectric body layer 28 to at least 4 μm or more than the width w3 of the lower electrode film 27. Thus, in a case where the BE width ratio is 45.7%, the minimum value of the TP width ratio that can be taken is 51.4% (in the embodiment, the width w2 of the piezoelectric body layer 28 is 36 μm). In a case where the BE width ratio is 50.0%, the minimum value of the TP width ratio that can be taken is 55.7% (in the embodiment, the width w2 of the piezoelectric body layer 28 is 39 μm). In a case where the BE width ratio is 54.3%, the minimum value of the TP width ratio that can be taken is 60.0% (in the embodiment, the width w2 of the piezoelectric body layer 28 is 42 μm). In a case where the BE width ratio is 60.0%, the minimum value of the TP width ratio that can be taken is 65.7% (in the embodiment, the width w2 of the piezoelectric body layer 28 is 46 μm). In a case where the BE width ratio is 71.4%, the minimum value of the TP width ratio that can be taken is 77.1% (in the embodiment, the width w2 of the piezoelectric body layer 28 is 54 μm). In a case where the BE width ratio is 80.0%, the minimum value of the TP width ratio that can be taken is 85.7% (in the embodiment, the width w2 of the piezoelectric body layer 28 is 60 μm). In a case where the BE width ratio is 85.7%, the minimum value of the TP width ratio that can be taken is 91.4% (in the embodiment, the width w2 of the piezoelectric body layer 28 is 64 μm).

As illustrated in FIG. 6, in a case where the BE width ratio is 45.7% and 85.7%, the value of the excluded volume is less than 90%. Meanwhile, in a case where the BE width ratio is 50.0%, 54.3%, 60.0%, 71.4%, and 80.0%, the value of the excluded volume is more than 90%. Here, if the excluded volume is 90% or more, a sufficient exclusion deposition to a degree that drop can be permitted for the exclusion deposition 100% is obtained. That is, the ejection performance of the recording head 3 is sufficiently obtained. Thus, a case where the excluded volume is 90% or more is set as an allowable value and the BE width ratio falls within a range of 50% or more and 80% or less. Furthermore, also in a case where the BE width ratio is any of between 50.0% and 80.0%, the value of excluded volume starts to fall sharply from a point in which the TP width ratio roughly exceeds 80.0%. Then, the value of excluded volume is approximately 90% when the TP width ratio is 90.0% and the value of excluded volume is expected to be less than 90% when the TP width ratio is greater than this. Thus, the TP width ratio falls within a range of 90% or less.

As described above, when the BE width ratio is set to be 50% or more and 80% or less and the TP width ratio is set to be a range of 90% or less, the value of excluded volume is set to be a range more than 90%. That is, in the region corresponding to the pressure chamber 22, when the lower electrode film 27 is formed with the width of 50% or more and 80% or less of the width of the pressure chamber 22 and the piezoelectric body layer 28 is formed with the width of 90% or less of the width of the pressure chamber 22, it is possible to improve the excluded volume when driving the piezoelectric element 19. As a result, it is possible to efficiently eject the ink from the nozzle 25.

Meanwhile, as illustrated in FIG. 6, when the BE width ratio is 54.3%, 60.0%, and 71.4%, it can be understood that the value of excluded volume is 97% or more when the TP width ratio is 80% or less. That is, in the region corresponding to the pressure chamber 22, when the lower electrode film 27 is formed with the width of 54% or more and 72% or less of the width of the pressure chamber 22 and the piezoelectric body layer 28 is formed with the width of 80% or less of the width of the pressure chamber 22, the value of excluded volume is set to be a range of approximately more than 97%. Thus, it is preferable that the width of the lower electrode film 27 be 54% or more and 72% or less of the width of the pressure chamber 22 and it is preferable that the width of the piezoelectric body layer 28 be 80% or less of the width of the pressure chamber 22. Thus, it is possible to further improve the excluded volume when driving the piezoelectric element 19. As a result, it is possible to further efficiently eject the ink from the nozzle 25.

Moreover, a method for measuring the excluded volume can be considered various members and in the embodiment, the excluded volume is obtained by measuring a deflection amount of the piezoelectric element 19 by a light interference microscope by connecting the drive signal to a body in a state where the actuator unit 14 is laminated on the pressure chamber forming substrate 15 and applying a predetermined drive voltage to the piezoelectric element 19. Moreover, as the method for measuring the displacement amount of the piezoelectric element 19, there is a method using a laser Doppler vibration galvanometer and the like.

Meanwhile, the invention is not limited to the embodiment described above and can be variously modified based on the description of the claims.

Figure 7:
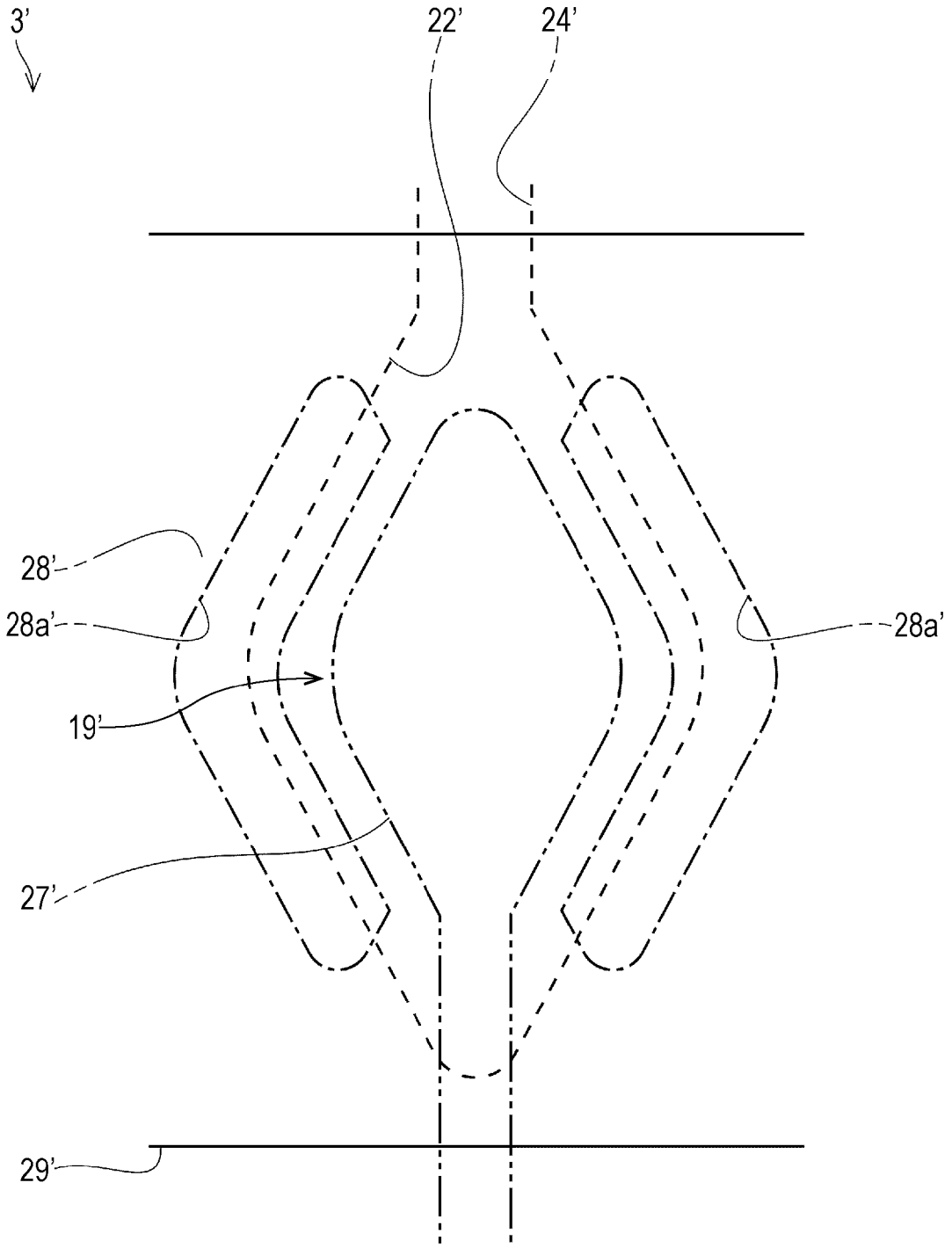
FIG. 7 is a plan view of a recording head of a second embodiment.

For example, in the embodiment described above, the upper opening of the pressure chamber space (the pressure chamber 22) has a trapezoidal shape and the opening section 28*a* formed of the piezoelectric body layer 28 has an elongated hexagonal shape, but the invention is not limited to the embodiment. The shape of the pressure chamber space (pressure chamber), the shape of the piezoelectric body layer (opening section), the shape of each electrode film, and the like can take a variety of shapes. For example, in a recording head 3' of a second embodiment, an upper opening of a pressure chamber space (pressure chamber 22') has a substantially elliptical shape (or a substantially diamond shape) in a plan view. Furthermore, a lower electrode film 27' is formed in a substantially elliptical shape (or substantially diamond shape) to match the shape of the pressure chamber 22'. Furthermore, an opening section 28*a*' of a piezoelectric body layer 28' is formed on both sides in the nozzle column direction of the pressure chamber 22' along an edge of the upper opening of the pressure chamber 22'. Moreover, similar to the embodiment described above, an upper electrode film 29' extends to the outside of a plurality of pressure chambers 22' provided side by side in the arrangement direction (nozzle column direction) of the pressure chambers. Furthermore, an end portion of the upper electrode film 29' on one side (upper side in FIG. 7) in the longitudinal direction of the pressure chamber 22' extends to a position overlapping an ink supply path 24' and an end portion on the other side (lower side in FIG. 7) extends outside of the pressure chamber 22'.

Then, also in the embodiment, in the region corresponding to the pressure chamber 22', the lower electrode film 27' is formed with the width of 50% or more and 80% or less of the width of the pressure chamber 22' and the piezoelectric body layer 28' covers the lower electrode film 27' and is formed with the width of 90% or less of the width of the pressure chamber 22'. Specifically, in the region corresponding to the pressure chamber 22', it is preferable that the width of the lower electrode film 27' be 54% or more and 72% or less of the width of the pressure chamber 22' and it is preferable that the width of the piezoelectric body layer 28' be 80% or less of the width of the pressure chamber 22'. Thus, it is possible to further improve the excluded volume when driving the piezoelectric element 19' and it is possible to further efficiently eject the ink. Moreover, since the other configurations are the same as that of the embodiment described above, the description will be omitted.

Meanwhile, regarding the widths of the lower electrode film, the piezoelectric body layer, and the pressure chamber, as the first embodiment described above, in the region corresponding to the pressure chamber 22, if the widths (dimensions in the nozzle column direction) of the lower electrode film 27, the piezoelectric body layer 28, and the pressure chamber 22 are substantially equal to each other, average widths of the lower electrode film 27, the piezoelectric body layer 28, and the pressure chamber 22 can be set as respective widths of the lower electrode film 27, the piezoelectric body layer 28, and the pressure chamber 22 within the numerical ranges described above. Furthermore, the width of the pressure chamber, the lower electrode film, or the piezoelectric body layer is changed in the middle of using, a width of a region corresponding to a main portion of the active section including a center of the active section in the longitudinal direction of the piezoelectric element can be set as the width of the pressure chamber, the width of the lower electrode film, or the width of the piezoelectric body layer within the numerical ranges described above. For example, if the end portion of the lower electrode film on the lead electrode section is thinned in the middle thereof, the width of the lower electrode film in the region corresponding to the pressure chamber other than the thinned portion is set the numeral range described above. Furthermore, as the second embodiment described above, in the region corresponding to the pressure chamber 22', if the widths (dimensions in the nozzle column direction) of the lower electrode film 27', the piezoelectric body layer 28', and the pressure chamber 22' are greatly different depending on locations (direction orthogonal to the nozzle column direction), it is preferable that the widths of the lower electrode film 27', the piezoelectric body layer 28', and the pressure chamber 22' in each location be set to be within the numerical ranges described above. At least in a portion in which the active section of a piezoelectric element 19' that is greatly influenced by the displacement amount becomes a maximum width, the widths of the lower electrode film 27', the piezoelectric body layer 28', and the pressure chamber 22' may be set to be within the numerical ranges described above. For example, in a substantially center portion in the direction orthogonal to the nozzle column direction, in the region in which the width of the pressure chamber 22' in a substantially elliptical shape (or substantially diamond shape) becomes a maximum, the widths of the lower electrode film 27', the piezoelectric body layer 28', and the pressure chamber 22' may be set to be within the numerical ranges described above. In short, in the portion (that is, the portion in which the width of the active section of the piezoelectric element 19' becomes a maximum) in which the width of the pressure chamber 22' becomes a maximum, since the displacement amount (deformation amount) of the piezoelectric element 19' is increased and is greatly influenced by the excluded volume, it is possible to expect improvement of the excluded volume.

Then, in the embodiments described above, the ink jet type recording head equipped in the ink jet printer is exemplified, but it is also possible to apply to an apparatus ejecting a liquid other than ink as long as the piezoelectric element and the pressure chamber having the configuration described above are included. For example, the invention can be applied to a color material ejecting head used for manufacturing a color filter of a liquid crystal display and the like, an electrode material ejecting head used for an electrode of an organic Electro Luminescence (EL) display and a field emission display (FED), a bio-organic material ejecting head used for manufacturing bio-chips (biological and chemical elements), and the like. In addition, the invention is not limited to one that includes the piezoelectric element functioning as a so-called actuator that is actively deformed by applying a voltage and can be applied to one that includes a piezoelectric element functioning as a sensor that passively outputs an electrical signal by movement being applied from outside.

What is claimed is:

1. A liquid ejecting head comprising:

a pressure chamber forming substrate in which a plurality of spaces to be pressure chambers in communication with nozzles are provided side by side in a first direction; and a piezoelectric element which faces a vibration plate defining the pressure chambers by sealing openings of the spaces in the pressure chamber forming substrate and in which a first electrode layer, a piezoelectric body layer, and a second electrode layer are laminated in order from the side of the vibration plate, wherein in a region corresponding to the pressure chamber, the first electrode layer is formed with a width of 50% or more and 80% or less of a width of the pressure chamber in the first direction and the piezoelectric body layer covers the first electrode layer in the first direction and is formed with a width of 90% or less of the width of the pressure chamber and an excluded volume of the pressure chamber when the piezoelectric element is driven by a predetermined drive voltage is 90% or more.

2. The liquid ejecting head according to claim 1, wherein in the region corresponding to the pressure chamber, the first electrode layer is formed with the width of 54% or more and 72% or less of the width of the pressure chamber in the first direction and the piezoelectric body layer is formed with the width of 80% or less of the width of the pressure chamber in the first direction.

3. A liquid ejecting apparatus comprising: the liquid ejecting head according to claim 2.

4. A liquid ejecting apparatus comprising: the liquid ejecting head according to claim 1.

* * * * *